US008950037B1

(12) United States Patent
Zimmerman

(10) Patent No.: US 8,950,037 B1
(45) Date of Patent: Feb. 10, 2015

(54) RUG RINSING TABLE AND METHOD

(75) Inventor: Michael A. Zimmerman, Greensboro, NC (US)

(73) Assignee: Zimmerman Carpet Cleaners, Inc., Greensboro, NC (US)

( * ) Notice: Subject to any disclaimer, the term of this patent is extended or adjusted under 35 U.S.C. 154(b) by 701 days.

(21) Appl. No.: 13/248,130

(22) Filed: Sep. 29, 2011

(51) Int. Cl.
*A47L 5/38* (2006.01)
*A47B 37/00* (2006.01)

(52) U.S. Cl.
USPC ..... 15/302; 15/300.1; 15/301; 15/310; 108/11; 108/17; 108/24

(58) Field of Classification Search
USPC ..... 15/300, 301, 302, 310, 346, 414, 415.1, 15/416; 108/11, 17, 24
See application file for complete search history.

(56) References Cited

U.S. PATENT DOCUMENTS

| | | | | |
|---|---|---|---|---|
| 3,772,732 | A * | 11/1973 | Gilmore | 15/309 |
| 6,513,192 | B1 | 2/2003 | Pearlstein | 15/415.1 |
| 7,040,239 | B2 * | 5/2006 | Shelton et al. | 108/50.13 |
| 7,296,321 | B2 * | 11/2007 | Cheng | 15/304 |

OTHER PUBLICATIONS

Manual showing the "Flash Xtractor™" by WaterClaw with a revision date of Apr. 27, 2011.

* cited by examiner

*Primary Examiner* — Saeed T Chaudhry
(74) *Attorney, Agent, or Firm* — Blake P. Hurt

(57) ABSTRACT

A low profile rinsing table is provided for cleaning rugs and other articles. The table includes an upper member having a series of apertures therein. Cleaning solutions can be scrubbed into the top of the rug and vacuum sources connected to the rinsing table will extract dirt, spent cleaning liquids and rinse water by pulling it through the rug, into a waste chamber and out for proper disposal. In an alternate embodiment of the rinsing table a roller extends along one side of the table to allow the rug to be easily indexed thereover.

11 Claims, 7 Drawing Sheets

RUG RINSING TABLE AND METHOD

FIELD OF THE INVENTION

The invention herein pertains to cleaning rugs and particularly pertains to cleaning rugs of various sizes utilizing a rinsing table.

DESCRIPTION OF THE PRIOR ART AND OBJECTIVES OF THE INVENTION

Commercial rug cleaning services have grown in recent years as most cleaning services now offer rug and carpet cleaning at the home or at a business owner's site as opposed to delivering the rug to a remote cleaning location. Some rug cleaning devices utilize a hand held or wand type vacuum extractor in which the rug is first sprayed with a soap/cleaning solution and is then scrubbed and vacuumed to remove, for example dirt and stains. In this process the rug remains in a flat position on the floor with the cleaning and extraction processes operating along the top surface of the rug. During scrubbing and vacuuming the dirty/contaminated liquids are pushed throughout the rug in a linear fashion and through unstained and clean portions of the rug. While such hand held wand devices are useful, it is very time consuming due to the relatively small size of the wand and the relatively large rug which has to be cleaned, scrubbed and vacuumed. Further, hand held wand type devices tend to leave dirt and debris along the bottom interior surface of the rug. (The term "rug" as used herein is generic and refers to rugs, carpets, runners and other textile type floor coverings without differentiation.)

Thus, in view of the problems and disadvantages associated with prior art rug cleaning devices, the present invention was conceived and one of its objectives is to provide a low profile rinsing table and method of use which will allow a rug to be first placed on the table, cleaned and rinsed with the liquids flowing completely through the rug.

It is another objective of the present invention to provide a low profile rinsing table which is relatively inexpensive to manufacture and sell.

It is still another objective of the present invention to provide a perforated rinsing table having vacuum outlets used to clean and rinse various size rugs in a quick, efficient manner.

It is yet another objective of the present invention to provide a rug rinsing table which does not require an extractor type wand.

It is a further objective of the present invention to provide a rug rinsing table which can be placed contiguous to similar tables for cleaning rugs of greater width.

It is still a further objective of the present invention to provide a rug rinsing table which utilizes a vacuum source to pull contaminated cleaning liquids from the top completely through the bottom of the rug for a thorough cleaning and to decrease the overall drying time of the rug.

It is yet a further objective of the present invention to provide a rinsing table in which both vacuum extraction and gravity are used simultaneously to effectively decrease the cleaning, rinsing and drying times.

Various other objectives and advantages of the present invention will become apparent to those skilled in the art as a more detailed description is set forth below.

SUMMARY OF THE INVENTION

The aforesaid and other objectives are realized by providing a relatively low profile rug rinsing table which allows a rug to be placed thereon for cleaning purposes. The rinsing table is rectangular and includes an upper planar member which defines a plurality of apertures within a margin and a lower continuous planar member with spacers between the upper and lower members. The upper and lower members are joined by end and side members forming a liquid waste chamber therein. A pair of vacuum ports on the lower member allow collected liquids and dirt to be drawn through apertures in the upper member, for example from a rug and into the waste chamber. The waste liquid then passes through vacuum ports in the lower member by suction for disposal. Such liquids may include water, cleaning fluids, dirt and debris all of which have been removed from the rug. Internal spacers maintain the separation of the upper and lower members to form the waste chamber and adjustable legs affixed to the lower member provide support above a floor or other substrate. Depending on the size of the rug to be cleaned, an optional filler film is provided which can be utilized to cover any free apertures in the upper member in order to create a better vacuum during rinsing and cleaning. A neoprene seal is also provided on the ends of the table to allow another identical table to be positioned therebeside for cleaning of larger sized rugs. In an alternate embodiment of the rinsing table a roller along one side provides for easy indexing of the rug. Vacuum ports are positioned on one end of the table and small apertures in the upper member assist in cleaning and rinsing rug fringe.

In use, the rinsing table is positioned on a stable substrate and the legs adjusted as needed for leveling purposes, a vacuum source is affixed by hoses to the vacuum ports. A dirty or stained rug is then positioned over the apertures on the upper member, the vacuum source activated and a cleaning solution is applied to the rug. The cleaning solution is scrubbed into the rug as needed to remove all stains. Thereafter rinse water is applied while the vacuum source pulls the contaminated and used liquids, dirt and debris vertically first through the rug, then through the apertures in the upper member and into the waste chamber where the liquids are then removed by passing through the vacuum ports and on toward the vacuum source for appropriate waste disposal. This cleaning method allows a more thorough cleaning and a decrease in overall cleaning and drying times of the rug. Thereafter the rug is removed and the table utilized for cleaning another rug or stored for future use.

DETAILED DESCRIPTION OF THE PREFERRED EMBODIMENT AND OPERATION OF THE INVENTION

Figure 1:
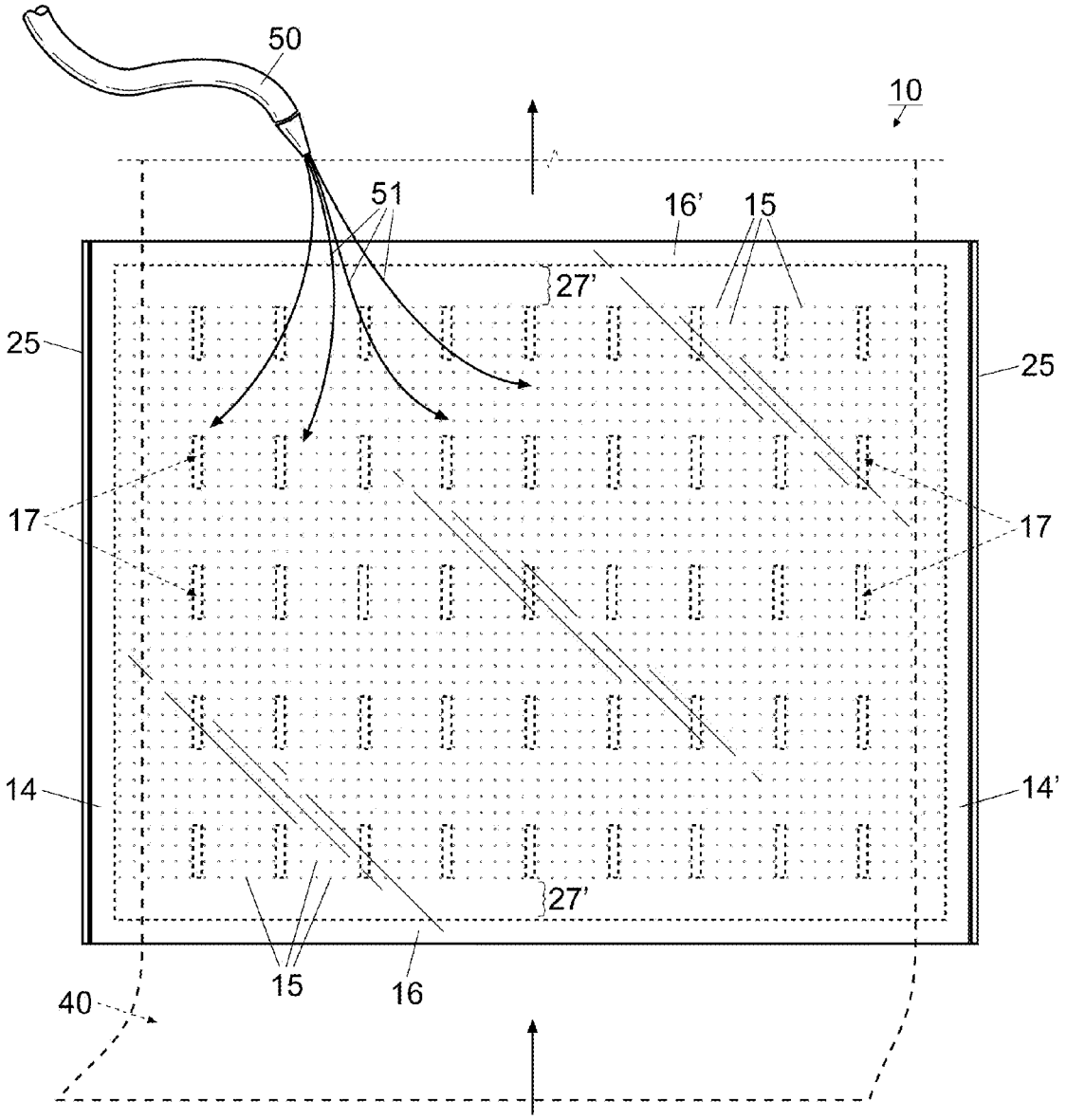
FIG. 1 shows a top view of the rinsing table of the invention with a rug shown thereon in outline form.

For a better understanding of the invention and its operation, turning now to the drawings, FIG. 1 shows a top view of preferred rinsing table 10 with a section of conventional area rug 40 shown in outline fashion thereon. Water hose 50 is shown spraying water 51 onto rug 40. Rinsing table 10 includes a planar upper member 11 and planar lower member 12 as shown in cutaway fashion in FIG. 4 which are preferably rectangular in shape and formed from a one eighth inch acrylic sheet. Upper member 11 and lower member 12 are joined together on each end by end members 14, 14' and on each side by side members 16, 16' to form waste chamber 13 therein. End members 14, 14' and side members 16, 16' are preferably formed from nylon but other suitable materials may also be used. Upper member 11 is separated from lower member 12 approximately one inch by a plurality of spacers 17 also shown in FIGS. 2 and 4. Spacers 17 provide integrity to maintain upper member 11 in planar fashion above lower member 12 and form waste chamber 13. Upper member 11 includes a plurality of preferably ⅛ to ¼ inch (0.48-0.64 cm) apertures 15 therein. Apertures 15 are spaced approximately one inch (2.54 cm) apart and about five inches (12.7 cm) from the outer edge of upper member 11 to form margins 27, 27' thereon. These margins (27, 27') help contain liquids on the upper member from spilling onto the substrate below, particularly when the rug is being moved or indexed along upper member 11. Spacers 17 may consist of rigid polymeric blocks formed from nylon having a size of approximately one inch (2.54 cm) in width and about three inches (7.62 cm) in length which help assist in preventing blockage of apertures 15. The exact number and size of apertures 15 can vary depending on the dimensions of upper member 11.

Figure 2:
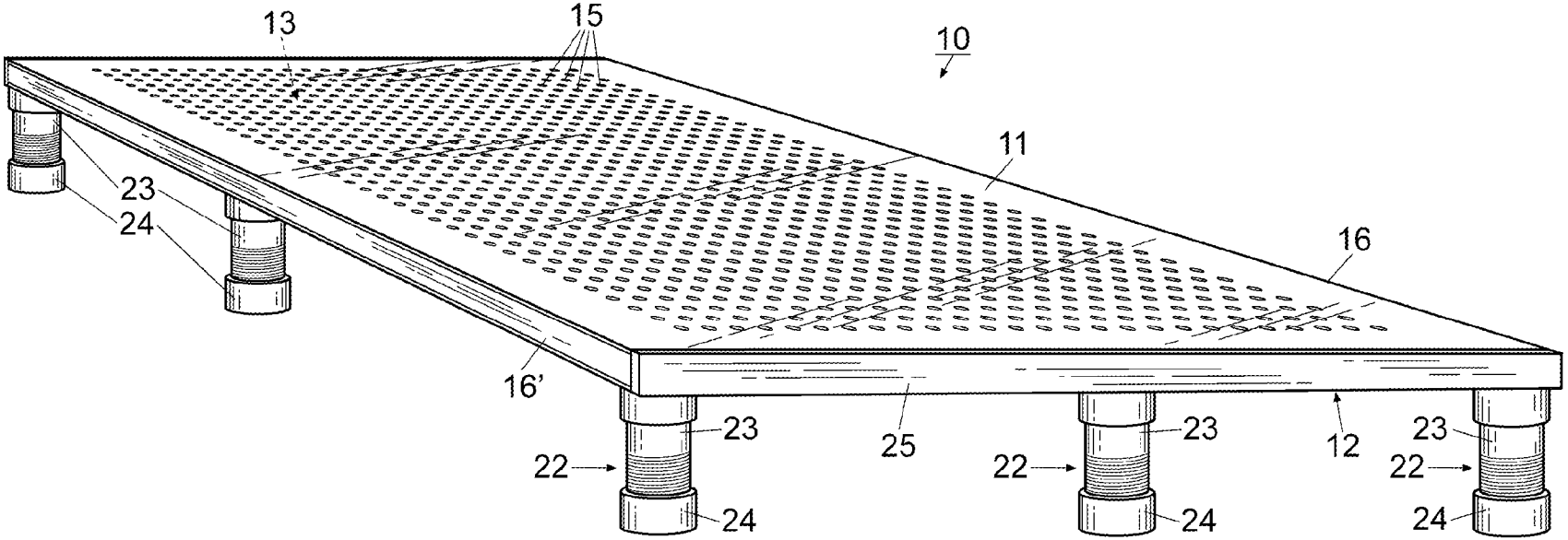
FIG. 2 depicts a top, end perspective view of the rinsing table.
Figure 3:
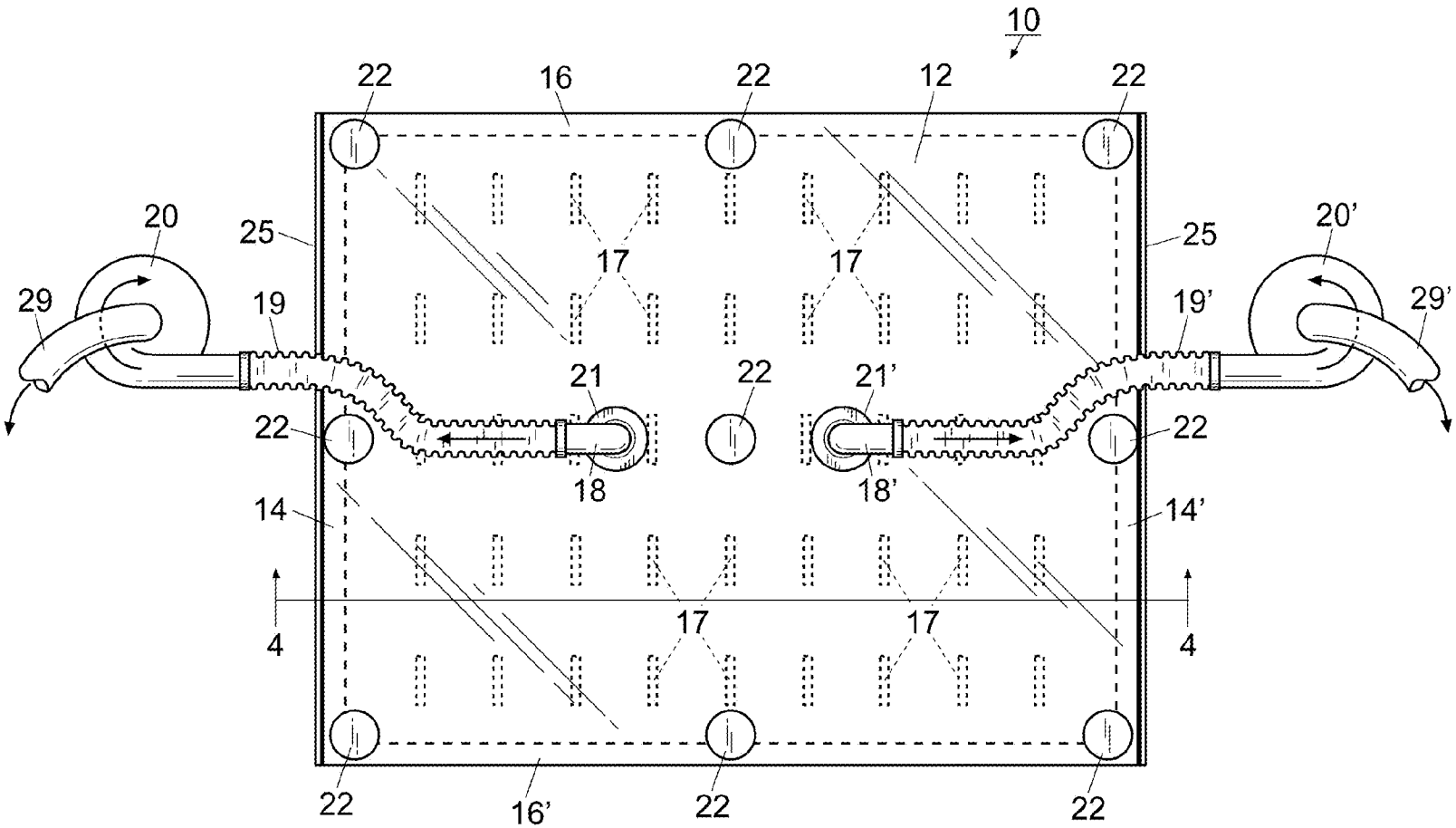
FIG. 3 demonstrates a bottom view of the rinsing table with a vacuum source affixed to each of the vacuum ports on the lower member.
Figure 4:
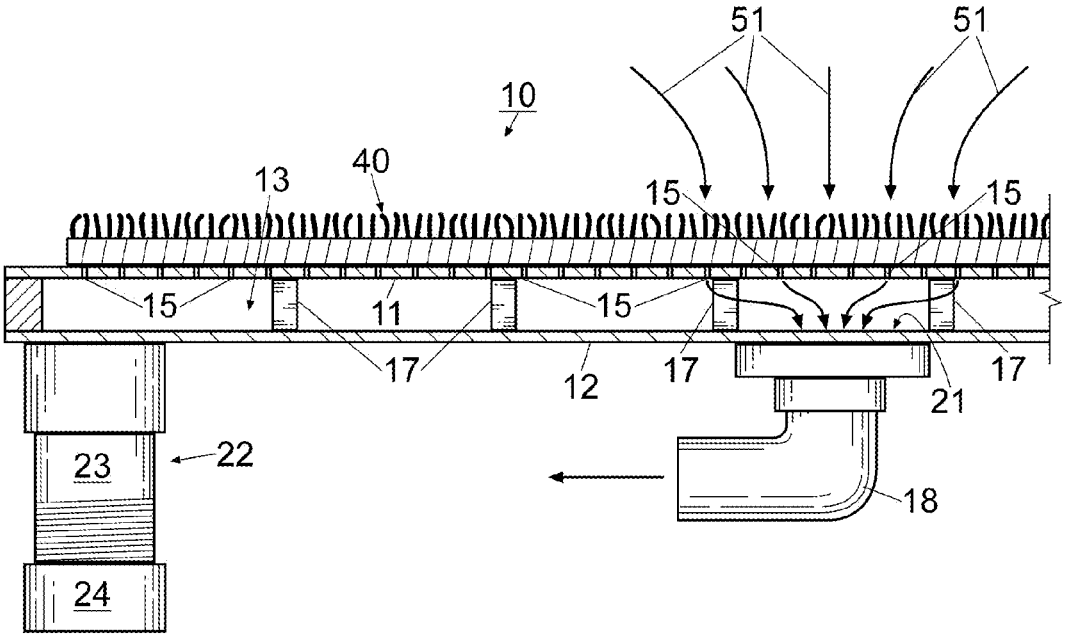
FIG. 4 illustrates a cross-sectional view of the rinsing table shown with a rug thereon.

Affixed to lower member 12 at each corner, along the sides and in the middle are eight (8) adjustable cylindrical legs 22 having a diameter of about four inches (10.16 cm) which each include a threaded upper portion 23 as shown in FIGS. 2 and 4 and a lower friction producing surface 24. Legs 22 are relatively short, six to eight inches (15.24-20.32 cm) in overall length. Threaded portion 23 allows each of legs 22 to be adjusted for leveling rinsing table 10 when placed on a uneven floor or other surface. Friction producing surface 24 of legs 22 maintain rinsing table 10 in position when cleaning a rug thereon. While legs 22 are shown in a round or cylindrical configuration, a single flange (not shown) could instead be placed along one or both sides of table 10. Lower member 12 also includes a pair of vacuum ports 21, 21' with respectively L-shaped hose connections 18, 18' affixed thereto. Vacuum hoses 19, 19' are connected to hose connections 18, 18' for attachment to standard vacuum sources 20, 20' respectively as seen in FIG. 3. Conduits 29, 29' allow waste liquids to pass to sewer lines or other appropriate disposal outlet.

Figure 6:
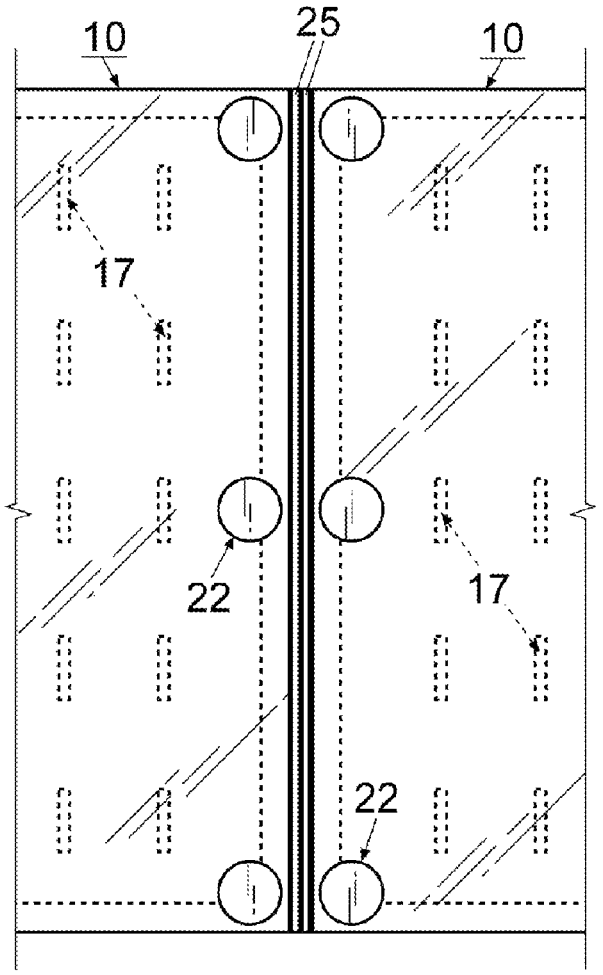
FIG. 6 pictures a pair of partial identical rinsing tables which are joined along the ends for cleaning a wide rug.

A conventional elastomeric seal 25 is placed along each of ends 14, 14' of preferred rinsing table 10 as shown in FIGS. 1 and 6. Seal 25 is provided so that when two or more tables 10 are combined as shown in FIG. 6, water or other cleaning fluids do not leak between the tables. Seal 25 may be preferably about one eighth of an inch (0.31 cm) thick and is formed from conventional neoprene strips and adhered by a suitable adhesive.

Figure 5:
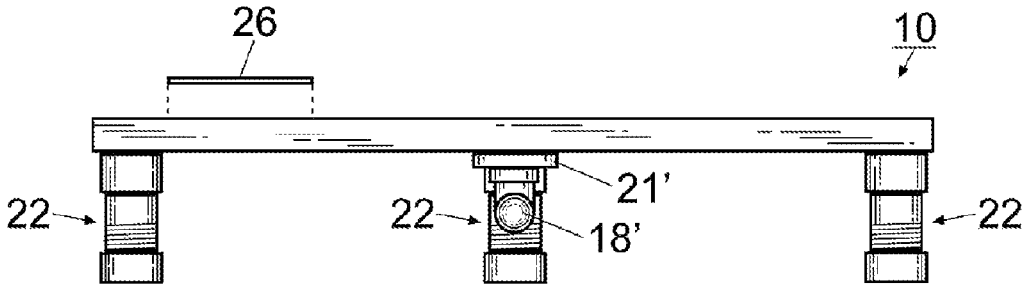
FIG. 5 shows an end elevational view of the rinsing table with a filler film exploded therefrom.

Rinsing table 10 is preferably about sixty inches (152.4 cm) long and forty-eight inches (122 cm) wide to accommodate a conventional rug such as a 9×12 or 10×14 rug. As would be understood, a section of a 9×12 rug can be placed on upper member 11 and by rinsing a section of the rug, the rug can then be manually indexed across upper member 11 as shown by arrows in FIG. 1 until the entire rug is cleaned and rinsed. For even faster cleaning and rinsing, two rinsing tables 10 can be placed side by side as shown in fragmented manner in FIG. 6 to increase the surface area of rinsing table 10. As shown in FIG. 6, tables 10, 10 there would have a width of four feet (122 cm) and a combined length of approximately ten feet (304 cm). Thus a 9×12 rug could be placed on the combined tables 10 indexing the rug approximately four times along the length, accommodating the full twelve feet. It being understood that the apertured area of upper member 11 is about three feet (91.4 cm) wide with spacing margins 27, 27' of about four to five inches (10.16-12.7 cm) along each side. Various liquids and solutions can be used to clean, scrub and rinse rug 40 such as water, soap solutions, solvents and the like. Once rug 40 has been placed on upper member 11 as shown in FIG. 1, vacuum sources 20, 20' can be activated to allow the cleaning fluids and rinse water to flow through rug 40, passing into apertures 15 through chamber 13 and into vacuum ports 21, 21'. Waste fluids so passing then pass through L-shaped hose connections 18, 18' and on through hoses 19, 19'. Hoses 19, 19' are connected to conventional vacuum sources 20, 20' shown in FIG. 3 for proper disposal through waste conduits 29, 29'. In the event a very small rug is to be cleaned such as a 2×4 rug, filler 26 (FIG. 5) which consists of a polymeric film is placed over the apertures 15 which are left exposed after the small rug (not shown) is placed on upper member 11 of table 10 to assist in sealing waste chamber 13 for efficient suction when vacuum sources 20, 20' are activated.

Figure 7:
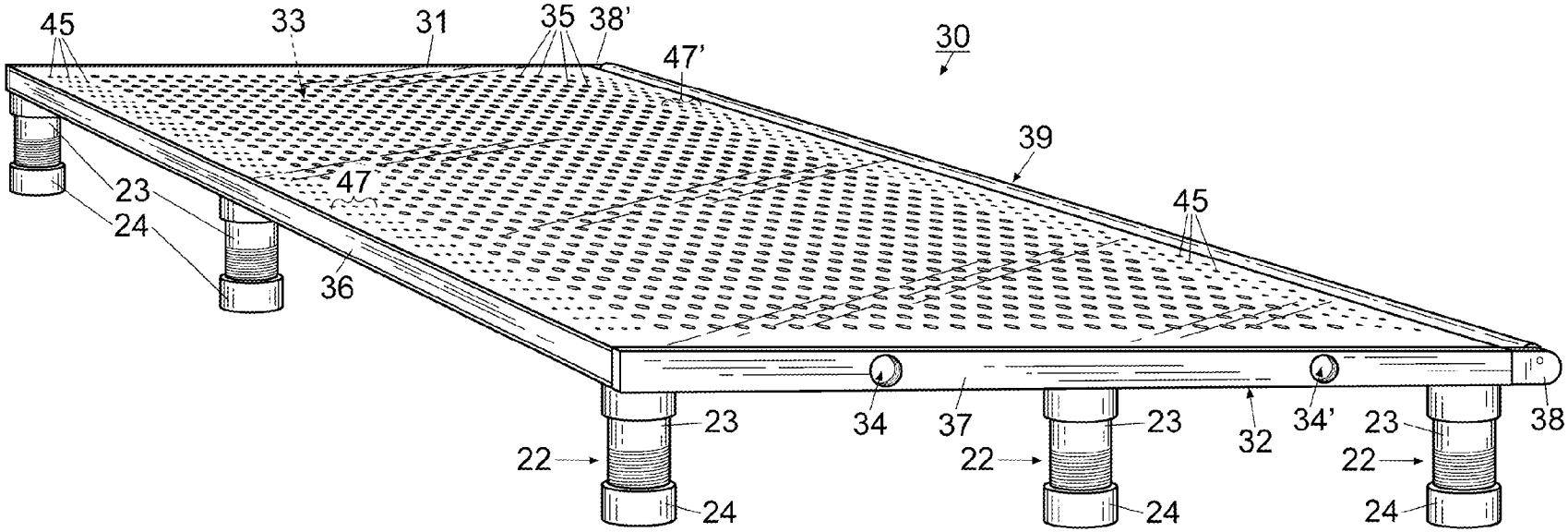
FIG. 7 depicts an alternate embodiment of the rinsing table with a roller affixed to one side for easily indexing the rug as it is rinsed.
Figure 8:
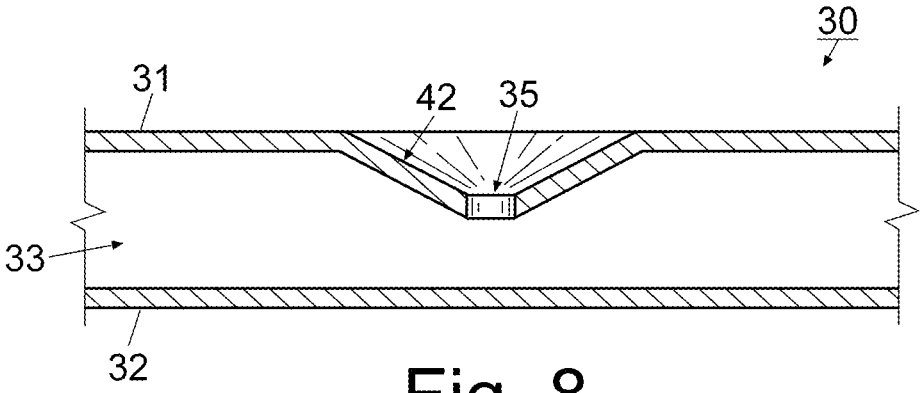
FIG. 8 demonstrates an enlarged fragmented cross-sectional view showing one of the large chamfered openings in the upper member.

In an alternate embodiment of the invention as shown in FIG. 7, rinsing table 30 includes upper member 31, lower member 32, side members 36 (only one side shown) and end members 37 (only one end shown) which are joined by conventional means such as an adhesive or the like. Legs 22 are also affixed as shown in preferred rinsing table 10 in FIGS. 1 and 2. Upper member 31 includes apertures 35 which are chamfered as shown in enlarged FIG. 8. As seen, each aperture 35 has a top chamfered surface 42 of approximately thirty degrees (30°). Vacuum chamber 33 formed between upper member 31 and lower member 32 has a height of approximately three inches (7.6 cm). Upper member 31 also includes a series of tiny apertures 45 which may be for example half or less the diameter of apertures 35. Four rows of apertures 45 extend along both sides of upper member 31 in margins 47, 47'. Apertures 45 are much smaller in diameter to assist in drying various rug fringes as are conventionally attached to the edges of rugs such as oriental rugs.

As further shown in FIG. 7 cylindrical roller 39 is secured to rinsing table 30 along one side. End brackets 38, 38' affixed to table 30 contain roller 39 in position to extend above upper member 31 approximately one sixteenth of an inch (1.78 mm). Roller 39 allows for convenience in the manual indexing of a rug thereon during the rinsing and cleaning process and may have a friction producing surface (not seen). Self lubricating bearings (not shown) are affixed at each end of roller 39 to maintain convenience in rotation. Vacuum ports 34, 34' are shown in end member 37. Vacuum ports 34, 34' are threaded for receiving conventional threaded vacuum hoses for connection to a vacuum source.

The preferred method of using rinsing table 10 consists of selecting a rug to be cleaned which may consist of a 4×6 rug such as rug 40 containing pet urine stains. Rinsing table 10 is placed on a stable surface such as on a garage or shop floor, driveway or the like. Rug 40 is placed face up over apertures 15 on rinsing table 10 as shown in FIG. 1. Soap or cleaning solution is applied to the top of rug 40 and can be manually brushed and scrubbed as needed into the top surface of rug 40 while vacuum sources 20, 20' are activated creating a vacuum between rug 40, chamber 13 and vacuum sources 20, 20' pulling the cleaning solution from the rug top surface vertically through the bottom surface of rug 40. Dirt, debris and the like are also pulled therethrough. As the soap solution is generally applied and rug 40 brushed/scrubbed with a conventional manual brush, rinse water 51 is applied over the top surface of rug 40 and is pulled downwardly through rug 40 with the now dirty, contaminated cleaning liquid, through apertures 15 and into waste chamber 13 where it will be suctioned through vacuum ports 21, 21' into L-shaped hose connections 18, 18', passing through hoses 19, 19' and past vacuum sources 20, 20' and into waste conduits 29, 29' for disposal. Once the cleaned surface of rug 40 appears dry, which may take a few minutes, vacuum sources 20, 20' are turned off so as to release the vacuum pressure on rug 40. Rug 40 is then indexed or manually pulled until the next uncleaned portion of rug 40 is positioned atop apertures 15 of rinsing table 10 whereby vacuum sources 20, 20' are again activated and the cleaning solution is again applied along with the brushing and rinsing of rug 40. Once the suction has removed the soap and dirty cleaning solutions, this rug section is then rinsed with clear water and the cycle continues until such time as the surface appears somewhat dry which is usually only a few minutes. After rinsing, vacuum sources 20, 20' are turned off and rug 40 can be removed or indexed as needed. Thereafter another rug can be positioned on rinsing table 10 for cleaning. Rinsing table 10 can be returned to its storage position after use. When wide rug widths are to be cleaned, one or more rinsing tables 10 can be positioned end to end for a greater width as seen in FIG. 6 for more efficient cleaning. Although conventional rugs are shown and used in the examples presented, other types of textile articles may also be used.

The illustrations and examples provided herein are for explanatory purposes and are not intended to limit the scope of the appended claims.

I claim:

1. A rinsing table comprising: a planer upper member, said upper member defining a plurality of apertures, a planar lower member, said lower member spaced from said upper member, a pair of opposing side members, a pair of opposing end members, said pair of side members and said pair of end members each joined to said upper member and said lower member to define a waste chamber therebetween, a seal, said seal positioned on one of said pair of end members, a vacuum port, said vacuum port communicating with said waste chamber, a leg, said leg affixed to said lower member whereby a vacuum source can be connected to said vacuum port for directing fluids from said upper member through said plurality of apertures.

2. The rinsing table of claim 1 wherein said plurality of apertures define a margin along said upper member.

3. The rinsing table of claim 1 further comprising an internal spacer, said internal spacer positioned within said waste chamber between said upper member and said lower member.

4. The rinsing table of claim 1 further comprising a roller, said roller attached to the rinsing table along one of said pair of side members.

5. A table for rinsing rugs comprising: an upper member, a lower member, said upper member spaced from said lower member to form a waste chamber therebetween, a seal, said seal positioned along one edge of said upper member, said upper member defining a plurality of apertures therein, a vacuum port, said vacuum port in communication with said waste chamber, whereby a vacuum source can be attached to said vacuum port to direct liquids from said upper member through said plurality of apertures and into said waste chamber.

6. The table of claim 5 further comprising a plurality of legs, said plurality of legs affixed to said lower member.

7. The table of claim 6 wherein said plurality of legs are adjustable, a plurality of friction producing surfaces, each of said plurality friction producing surfaces attached to different ones of said plurality of legs.

8. The table of claim 5 wherein said upper member and said lower member are each planar.

9. The table of claim 5 wherein said upper member and said lower member are each rectangular.

10. The table of claim 5 further comprising an additional vacuum port, said additional vacuum port in communication with said waste chamber.

11. The table of claim 5 further comprising a roller, said roller attached to said table proximate said upper member.

* * * * *